US006684608B2

(12) United States Patent
Gibbons

(10) Patent No.: US 6,684,608 B2
(45) **Date of Patent: *Feb. 3, 2004**

(54) SPRING UNITS FOR MATTRESSES AND THE LIKE

(75) Inventor: Francis Gibbons, Merseyside (GB)

(73) Assignee: Slumberland PLC, Oldham (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/171,070

(22) PCT Filed: Apr. 1, 1997

(86) PCT No.: PCT/GB97/00911

§ 371 (c)(1),
(2), (4) Date: Oct. 9, 1998

(87) PCT Pub. No.: WO97/37928

PCT Pub. Date: Oct. 16, 1997

(65) Prior Publication Data

US 2002/0026770 A1 Mar. 7, 2002

(30) Foreign Application Priority Data

Apr. 11, 1996 (GB) ..... 9607497

(51) Int. Cl.[7] ..... B65B 9/06; B65B 63/02

(52) U.S. Cl. ..... 53/436; 53/450; 53/114; 53/524; 53/528; 53/550

(58) Field of Search ..... 140/3 CA; 267/89, 267/91; 5/655.7, 655.8, 720; 29/91, 91.1, 896.92; 53/114, 418, 450, 550, 436, 439, 524, 526, 528, 530

(56) References Cited

U.S. PATENT DOCUMENTS

| | | | | | |
|---|---|---|---|---|---|
| 1,566,068 | A | * | 12/1925 | Brundage | 53/114 |
| 1,685,851 | A | * | 10/1928 | MacInerhey | 53/114 |
| 1,994,043 | A | * | 3/1935 | Lofman et al. | 53/114 |
| 2,114,008 | A | * | 4/1938 | Wunderlich | 53/114 |
| 2,430,098 | A | * | 11/1947 | Binch | 53/114 |
| 2,983,236 | A | * | 5/1961 | Thompson | 53/114 X |
| 3,059,387 | A | * | 10/1962 | Fasanella | 53/418 |
| 3,173,188 | A | * | 3/1965 | Wexler | 53/439 |
| 3,668,816 | A | * | 6/1972 | Thompson | 53/418 |
| 4,328,655 | A | * | 5/1982 | Spencer et al. | 53/439 |
| 4,439,977 | A | * | 4/1984 | Stumpf | 53/114 X |
| 4,854,023 | A | * | 8/1989 | Stumpf | 53/114 X |
| 5,127,635 | A | * | 7/1992 | Long et al. | 267/91 |
| 5,303,530 | A | * | 4/1994 | Rodgers | 53/114 |
| 5,438,718 | A | * | 8/1995 | Kelly et al. | 29/91.1 X |
| 5,572,853 | A | * | 11/1996 | St. Clair et al. | 53/114 X |

FOREIGN PATENT DOCUMENTS

| | | | | |
|---|---|---|---|---|
| DE | 2545813 | * | 4/1977 | 53/528 |
| DE | 3407006 | * | 8/1985 | 53/528 |
| EP | 0 052 389 | | 5/1982 | |

* cited by examiner

*Primary Examiner*—John Sipos
(74) *Attorney, Agent, or Firm*—Christensen O'Connor Johnson Kindness PLLC

(57) ABSTRACT

A spring unit comprises a continuous coil spring (5) contained within a sleeve (26) of strong, yet flexible, material. The unit is produced by providing a folding attachment device (2) having oppositely inclined spaced walls (13, 14) which converge from a feed end (3) to an outlet end (4), and simultaneously drawing the flexible material and the coil spring through the folding attachment device from the feed end to the outlet end with the spaced walls acting to fold the material over the coil spring and to apply a substantially uniform compressive force to the coil spring. As the material and the spring are drawn through the outlet end (4), overlapping edges of the flexible material are joined together to complete the spring unit.

3 Claims, 4 Drawing Sheets

SPRING UNITS FOR MATTRESSES AND THE LIKE

This is a United States national application corresponding to copending international application PCT/GB97/00911, filed Apr. 1, 1997, which designates the United States, the benefit of the filing date of which is hereby claimed under 35 U.S.C. §120, which in turn claims the benefit of British application No. 9607497.6 filed Apr. 11, 1996, the benefit of the filing date of which is hereby claimed under 35 U.S.C. 119.

This invention relates to spring units for use in mattresses, spring upholstered furniture and the like, and to a method and apparatus for manufacturing such spring units. The invention also relates to a spring interiors comprised of a plurality of such spring units.

In our International Patent Application number WO90/01285, we have disclosed a spring unit comprising a continuous coil spring contained within a sleeve of strong, yet flexible, material. In one of the arrangements described in WO90/01285 a separately formed sleeve of calico material is carried on a tubular former and a band of continuous coil spring is drawn off a reel, through one end of the former and out the other end. As the band passes through the former it draws off the sleeve from the former and entrains it around itself. In another arrangement described in WO90/01285 a continuous sheet of calico is carried on a reel and the band of continuous coil spring in wound on a reel. The free ends of the calico material are drawn through a V-shaped former which serves to direct the sides of the sheet up and around the band. The sides of the calico are drawn together above the former and are stitched together.

In the former arrangement additional steps are required in separately forming the sleeve and loading the sleeve onto the former before the sleeve can entrain itself around the band. In the latter arrangement, in which the sleeve is formed simultaneously with entrainment around the band, difficulty is experienced in applying an even compression to the continuous coil spring as the material is wrapped around it.

According to our invention a spring unit comprising a continuous coil spring contained within a sleeve of strong, yet flexible, material is produced by providing a folding attachment device having oppositely inclined spaced walls which converge from a feed end to an outlet end, and simultaneously drawing the flexible material and the coil spring through the folding attachment device from the feed end to the outlet end with the spaced walls acting to fold the material over the coil spring and to apply a substantially uniform compressive force to the coil spring whereafter as the material and the coil spring are drawn through the outlet end, overlapping edges of the flexible material are joined together to form the sleeve and complete the spring unit.

The provision of the attachment device enables us to produce spring units in a continuous operation, with a substantially uniform compressive forced applied to the spring.

The inclined walls are interconnected at one pair of adjacent edges by a support plate which supports the flexible material, and the material is fed through a gap at the feed end of the folding attachment device between the support plate and a guide bar which ensures the material does not buckle or crease as it is drawn through the folding attachment device, the material being folded over the coil spring as the material and the coil spring exit from the outlet end of the folding attachment device.

The overlapping edges of the material may be joined together by any convenient method. For example they may be stitched, glued, or heat welded together. The flexible material may comprise a single layer of the strong yet flexible material, such as calico, which is drawn through the folding attachment from the reel. Alternatively the material may be of composite construction comprising inner and outer layers of fabric with an insulator layer sandwiched therebetween. Such material may be preformed. Preferably, however, the three layers are drawn through the folding attachment device from separate, individual, reels.

When the overlapping edges of the flexible material are stitched together following exit from the folding attachment device, a sewing head is disposed between first and second variable speed puller feed mechanisms which act to drawn the material and the spring through the folding attachment device and act to tension overlapping edges between spaced stations for joining them together by the sewing head.

Conveniently both feed mechanisms co-operate with the overlapping edges of the fabric on opposite sides of the sewing head to maintain the edges in overlapping relationship for the sewing operation and to ensure the compressive force applied to the coil spring by the relative inclination of the spaced walls of the folding attachment is maintained.

The folding attachment device may be positioned with the support plate generally vertical and the inclined walls comprising upper and lower walls. This facilitates assembly since the sewing head produces a side seam, and the flexible material and a continuous coil spring are drawn from reels rotatable about generally vertical axes.

The spring unit produced by a continuous operation is of infinite length and is then cut to required lengths for the construction of mattresses and the like, as otherwise described in WO90/01285.

One embodiment of our invention is illustrated in the accompanying drawings.

Figure 1:
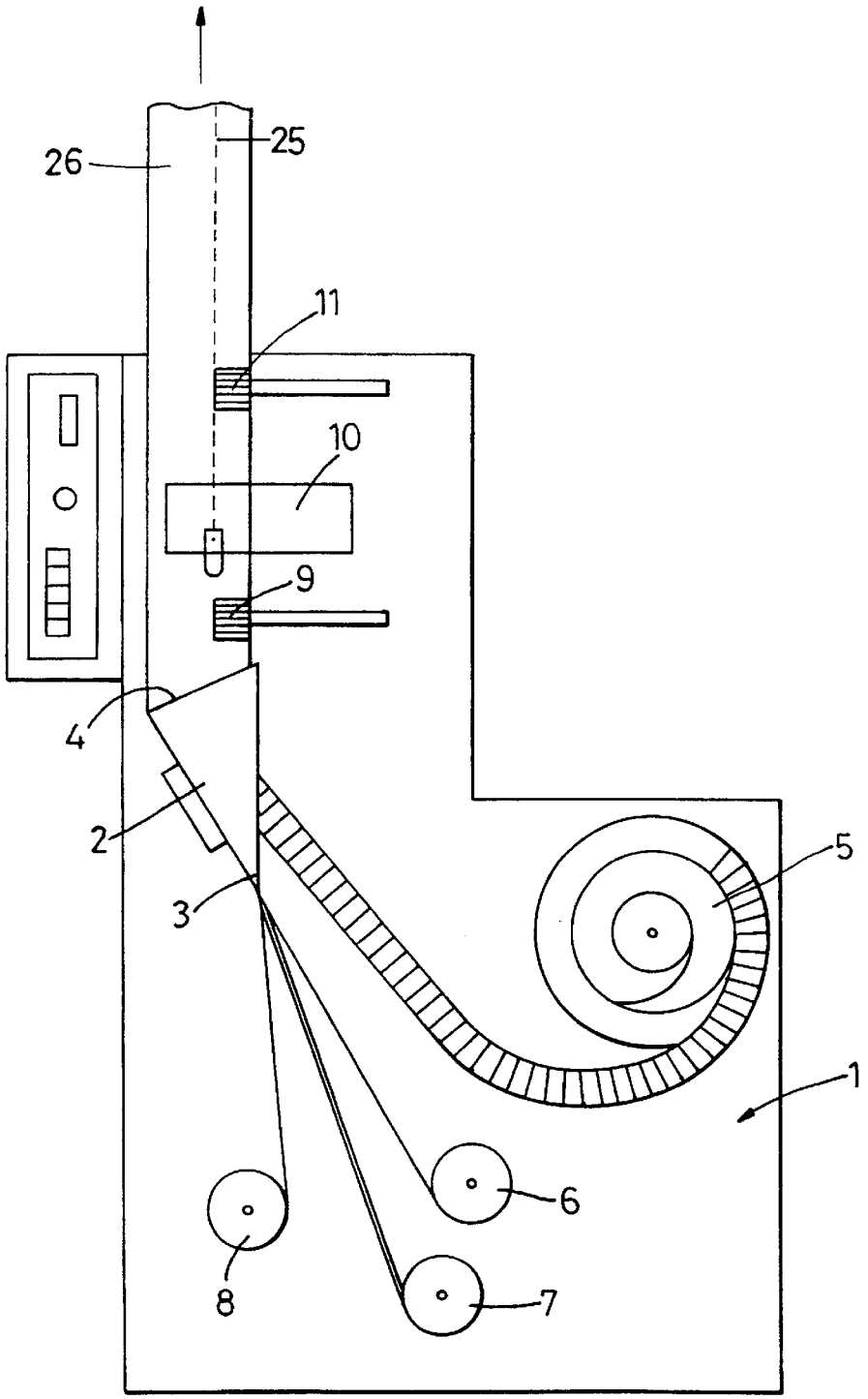
FIG. 1 is a plan view of a schematic layout of apparatus for manufacturing a spring unit.
Figure 2:
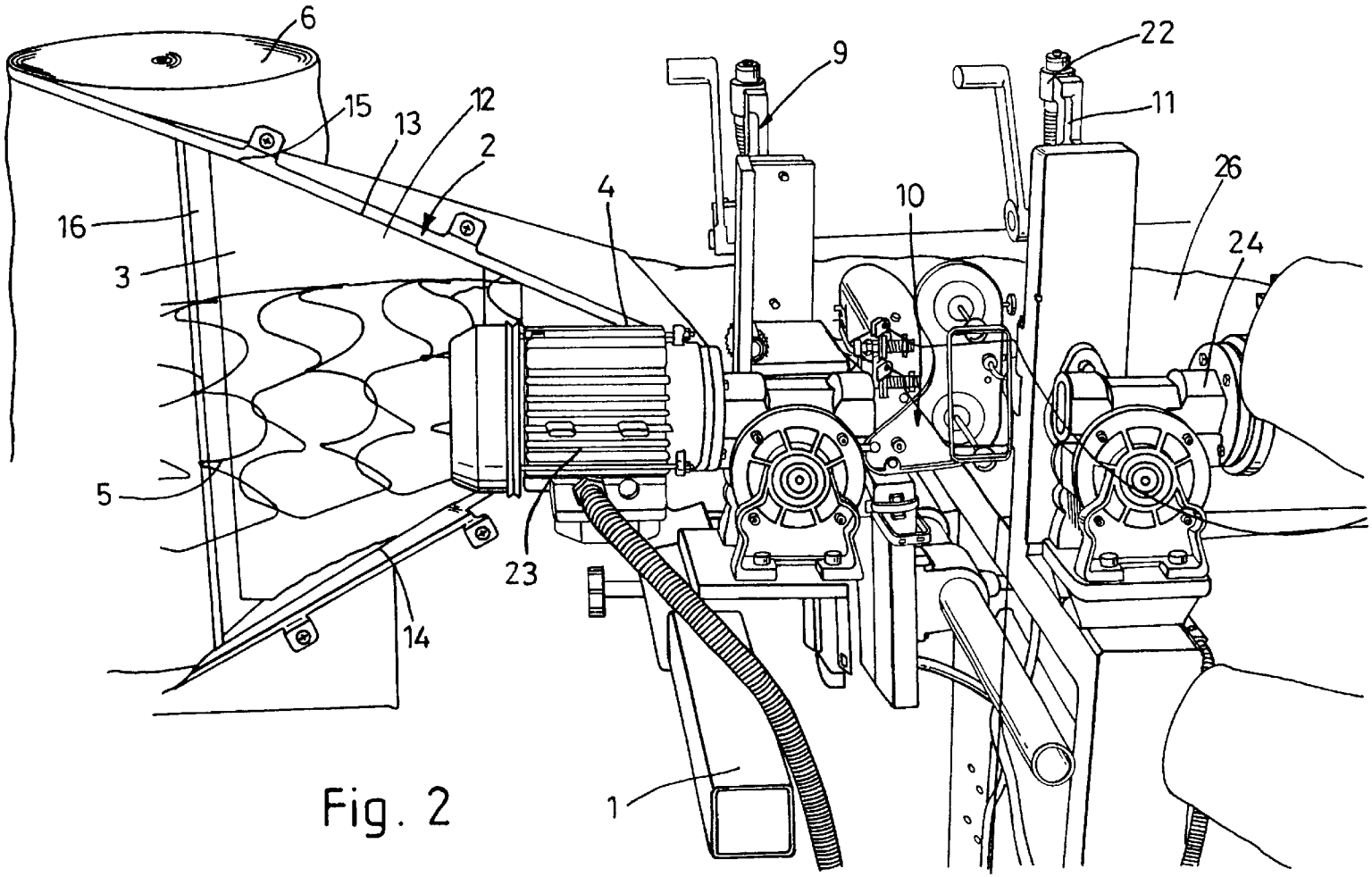
FIG. 2 is a side view of one practical form of the apparatus.
Figure 3:
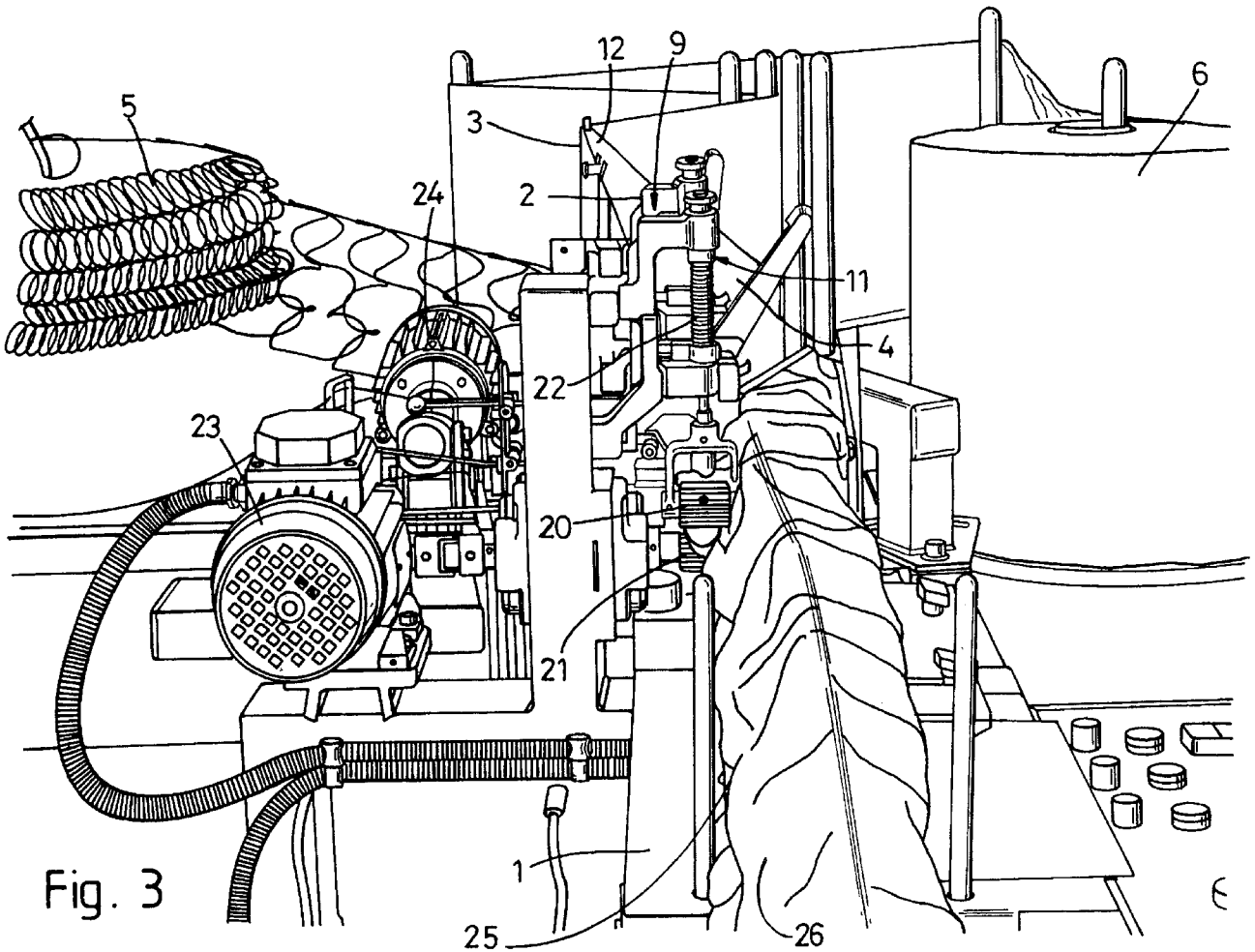
FIG. 3 is a view on the axis of the apparatus.

The apparatus illustrated in the drawings comprising a base frame 1 on which is mounted a folding attachment device 2 having a feed end 3 and an outlet end 4. A reel of continuous coil spring 5, a reel 6 of the inner fabric, a reel 7 of insulator material, and a reel 8 of outer fabric are mounted on the base frame 1 for rotation about vertical axes and at locations spaced from the feed end 3 of the folding attachment. The reel 5 is positioned adjacent to the reel 6 of inner fabric. A first inner variable speed puller feed mechanism 9 is mounted on the base frame 1 at the outlet end 4 of the folding attachment 2 and a variable speed chain stitch sewing head 10 is mounted on the frame 1 in a line between the puller feed mechanism 9 and a second outer variable speed puller feed mechanism 11, also mounted on the frame 1.

Figure 4B:
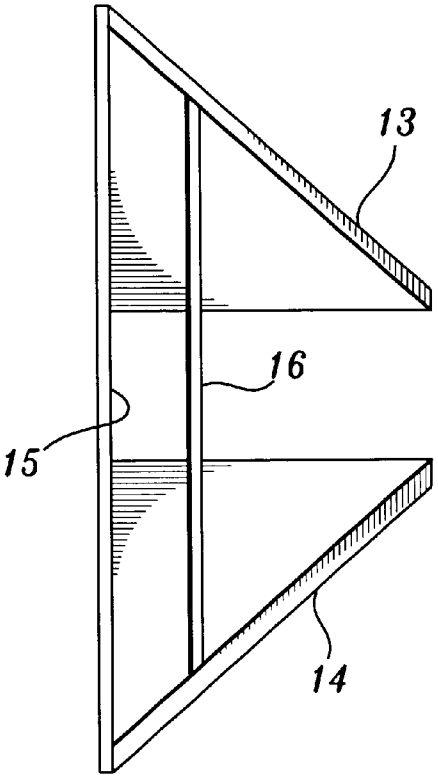
FIGS. 4A and 4B are detailed views showing the folding attachments schematically in side and rear views, respectively.
Figure 4A:
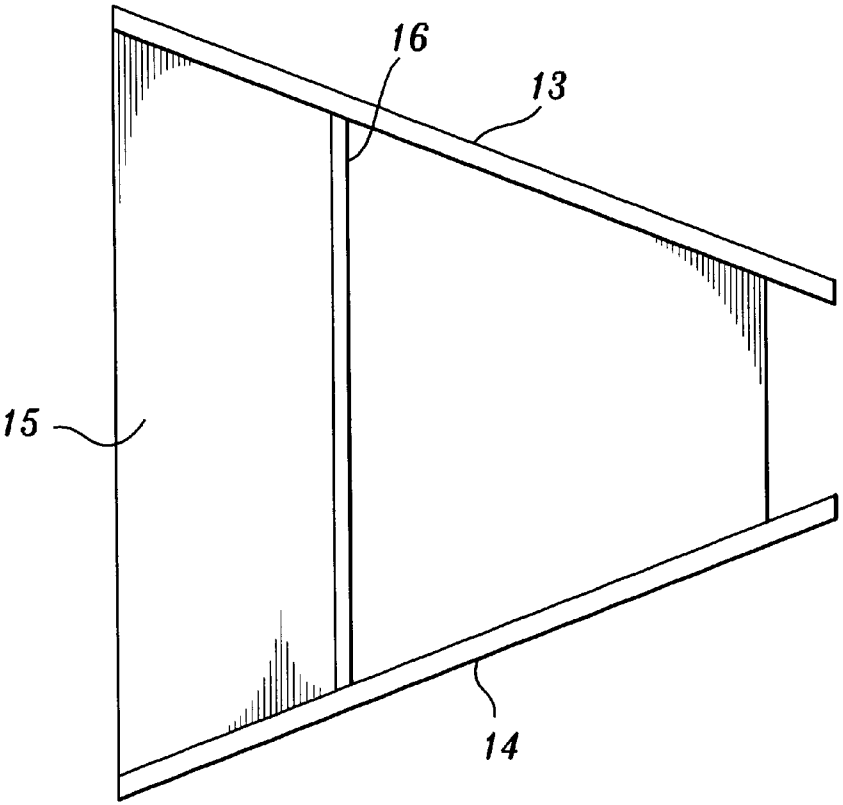

The folding attachment device 2 as shown in FIGS. 4A and 4B of the accompanying drawings comprises a metal component 12 of channel section comprising upper and lower planar walls 13, 14 which are oppositely inclined and converge from the feed end 3 to the outlet end 4. The walls are interconnected at one pair of adjacent edges by a support plate 15, and a guide bar 16 spaced by a gap from support plate 15 extends between the walls 13, 14 at the feed end of the folding attachment.

Each puller feed mechanism 9 and 11 comprises a pair of upper and lower toothed rollers 20,21 of which the spacing therebetween is adjustable by operation of an adjusting screw 22, and the lower roller 21 of each pair is rotatably driven by an associated electric motor 23,24, respectively.

In operation material from the three reels 6,7 and 8, all of a width greater than the developed width of the continuous coil spring 5 on the reel 9, is drawn into the feed end 3 of the folding attachment device 2 through a space between the support plate 15 and the guide bar 16, and the continuous coil 5 is also drawn into the folding attachment 2 into position at which it contacts the inner fabric from the reel 6. As the two components are drawn through the folding attachment device 2 by the puller mechanisms 9 and 11 the top and bottom edges of the inner and outer fabric and the insulator material fold over the top and bottom faces of the coil spring 5 by co-operation with the upper and lower walls 13,14 and with the spring itself subjected to a degree of compression by similar co-operation with the walls 13,14. The edges of the fabrics are drawn down over the inner face of the coil spring 5 and are gripped between the rollers 20,21 of each puller mechanism 9,11. The two mechanisms 9 and 11 acts in synchronism to draw the coil spring 5 and the fabric from the reels 6,7 and 8 and through the folding attachment device 2 to enclose the coil spring 5 within the fabric, thereby to form a continuous spring unit of infinite length.

The sewing head 10 is carried by a sewing arm which acts in synchronism with operation of the puller mechanisms 9,11 to stitch the overlapping edges of the fabric together to form a seam 25, thereby completing the spring unit.

The method of manufacture described above with reference to the apparatus illustrated in the drawings enables us to produced continuous lengths of spring unit in a single continuous operation in which a continuous coil spring 5 is sheathed in a sleeve or envelope 26 of strong yet flexible material in which a degree of compression may be applied to the coil spring 5 during the manufacture operation.

In a modification the stitching operation may be replaced by a gluing or heat welding operation, depending upon the suitability of the material comprising the fabric covering or coverings.

What is claimed is:

1. A method of manufacturing a spring unit for use in mattresses, spring upholstered furniture and the like, in which said spring unit comprises a continuous coil spring contained within a sleeve of strong, yet flexible material wherein the method comprises the steps of:

i) providing a folding attachment device having oppositely inclined spaced planar walls which converge from a feed end to an outlet end, said inclined walls being interconnected at one pair of edges by a support plate; said device further having a guide bar spaced from said support plate extends between said walls at said feed end;

ii) feeding said material through a gap between said support plate and said guide bar to ensure that said material does not buckle or crease as it is drawn through said folding attachment device;

iii) simultaneously drawing said flexible material and said coil spring through said folding attachment device from said feed end to said outlet end with said spaced walls acting to fold said material over said coil spring and to apply a substantially uniform compressive force to said coil spring; and iv) joining overlapping edges of said flexible material together at a joining station to form said sleeve and complete said spring unit as said material and said coil spring are drawn through said outlet end.

2. Apparatus for manufacturing a spring unit for use in mattresses, spring upholstered furniture and the like, in which said spring unit comprises a continuous coil spring contained within a sleeve of strong, yet flexible material, said apparatus comprising a folding attachment device having oppositely inclined spaced planar walls which converge from a feed end of an outlet end, a reel of continuous coil spring, a reel of flexible material, puller means for drawing said flexible material and said coil spring simultaneously through said folding attachment device from said feed end to said outlet end with said spaced walls acting to fold said material over said coil spring and to apply a substantially uniform compressive force to said coil spring, said attachment device including a support plate, and a guide bar, said inclined walls being interconnected at one pair of adjacent edges by said support plate, said material being fed through a gap between said support plate and said guide bar to ensure that said material does not buckle or crease as it is drawn through said folding attachment device, said material being folded over said coil spring as said material and said coil spring exit from said outlet end of said folding attachment device, and joining means for joining together overlapping edges of said flexible material as the material and said coil spring are drawn from said outlet end of said attachment device to form said sleeve and complete said spring unit.

3. Apparatus according to claim 2, wherein said joining means comprises a sewing head, and wherein said folding attachment device is positioned with said support plate generally vertical and said inclined walls comprising upper and lower walls, said flexible material, and said coil spring being drawn from reels rotatable about generally vertical axes, and wherein said sewing head is adapted to produce a side seam.

* * * * *